US007878093B1

(12) United States Patent
Peterman

(10) Patent No.: US 7,878,093 B1
(45) Date of Patent: Feb. 1, 2011

(54) ROTATOR SOCKET SUITABLE FOR THE INSTALLATION OF A CUP HOOK

(76) Inventor: Steven A. Peterman, 13230 "G" Fiji Way, Marina Del Rey, CA (US) 90292

( * ) Notice: Subject to any disclaimer, the term of this patent is extended or adjusted under 35 U.S.C. 154(b) by 0 days.

(21) Appl. No.: 12/716,189

(22) Filed: Mar. 2, 2010

(51) Int. Cl.
*B25B 13/50* (2006.01)
*B25B 13/06* (2006.01)

(52) U.S. Cl. ..... 81/124.2; 81/125

(58) Field of Classification Search ..... 81/119, 81/124.2, 180.1, 184, 125, 901; 279/145
See application file for complete search history.

(56) References Cited

U.S. PATENT DOCUMENTS

| | | | | |
|---|---|---|---|---|
| 882,937 | A | 3/1908 | Fegley | |
| 2,231,323 | A | 2/1941 | Cawood | |
| 3,901,298 | A | 8/1975 | Eby | |
| 4,004,476 | A * | 1/1977 | DeVrou | 81/177.2 |
| 4,530,261 | A * | 7/1985 | Ventura | 81/177.75 |
| 4,724,731 | A * | 2/1988 | Onofrio | 81/119 |
| 5,791,208 | A | 8/1998 | Grubbs | |
| 6,029,547 | A * | 2/2000 | Eggert et al. | 81/125 |
| 6,711,974 | B1 | 3/2004 | Lin | |
| 6,715,384 | B1 | 4/2004 | Kozak | |
| 6,729,210 | B2 | 5/2004 | Morris | |
| 7,082,864 | B1 * | 8/2006 | Weber | 81/184 |
| 2005/0132848 | A1 | 6/2005 | Tassano | |
| 2006/0254394 | A1 | 11/2006 | Cantlon | |
| 2007/0295173 | A1 | 12/2007 | Swartz | |
| 2008/0061571 | A1 | 3/2008 | Schopp | |

OTHER PUBLICATIONS

Eazypower Corporation, Isomax Ceiling Eye Installer, Catalog, Section 6, http://eazypower.com/pdf/Files/Section%2006.pdf, Chicago, Illinois, downloaded on Feb. 9, 2010.

Eazypower Corporation,5/16" Ceiling Eye Hook Lag-Screw Screw Driver 3" Long, Website, http://eazypower.com/shop/catalogsearch/result/index/?q=ceiling+eye+driver&x=23&y=7&p=2&mode=list, Chicago, Illinois, downloaded on Feb. 9, 2010.

* cited by examiner

*Primary Examiner*—Hadi Shakeri
(74) *Attorney, Agent, or Firm*—Howard Leslie Hoffenberg; The IP and Business Law Offices of Howard L. Hoffenberg, Esq.

(57) ABSTRACT

A rotator socket for use with a handheld power drill suitable to install a cup hook, the cup hook characterized by a rounded hook portion having wideness and a semi-spherical flange, comprised of a shank; a body; a slot; a depression and a resilient member.

14 Claims, 3 Drawing Sheets

ROTATOR SOCKET SUITABLE FOR THE INSTALLATION OF A CUP HOOK

BACKGROUND OF THE INVENTION

1. Field of the Invention

This invention pertains generally to tools and more particularly to slotted socket tools.

2. Related Art

As part of the celebration of Christmas, there is a custom to hang strings of lights commonly referred to as Christmas lights. These strings of lights are hung, inter alia, on surfaces of a home, and in particular, under the eaves of a home.

One method of hanging Christmas lights is to nail or staple the Christmas lights to a surface. This can result in short circuiting the light string. Removal of the Christmas lights after the holiday is awkwardly accomplished by pulling out the nails or staples with a pliers.

It has become widely known that cup hooks are useful to hang Christmas lights. As the name implies, a cup hook was designed for hanging a cup by its handle in a quasi-inverted fashion from a surface, typically, the underside of a shelve. A cup hook is characterized by a threaded shank having a pointed tip; a rounded hook portion that is continuous with the shank and a semi-spherical flange mounted orthogonal on the shank. The cup hook is typically made from brass and resistant to rust. Because cup hooks are made of brass, at the end of the holiday, they can either be removed or allowed to remain in place for use year to year.

Cup hooks can by manually installed into a surface by pressing the pointed tip against a surface, such as a fascia board or eave, and rotating by hand the cup hook using the hook portion of the cup hook. This method can be augmented by first punching a lead hole with a center punch and hammer. This method can also be augment by first drilling a lead into which the threaded shank is screwed. Typically, when installing Christmas lights, a few hundred to a few thousand cup hooks are utilized. Turning this many cup hooks by hand into surfaces can be a very arduous task.

Known in the art is US Patent Publication 2008/0061571 A1 to Schopp entitled "Method and Apparatus for Hanging a String of Lights." This Patent teaches a generally cylindrical socket for use with a broom handle for installing cup hooks. At the distal end of the cylindrical socket there is a depending narrow elongated slot that is centered within the socket. Also at the distal end are orthogonal channels. At the intersection of these orthogonal channels are four chamfered corners. The socket is used by inserting the hook portion of a cup hook into the slot until the flange rests against the four chamfered corners. This socket has the disadvantage of requiring a conformed fitting slot, otherwise the cup hook rattles around in the socket. The socket is further disadvantage by the four chamfered corners minimally embracing the flange and adding complexity to manufacture. The socket is still further disadvantage by lacking any capability to retain the cup hook within the socket against longitudinal motion, other than a precisely controlled slot width that is modicum narrower than the width of the cup hook wire. Accordingly, a user may need to maintain the socket in a prone position at all times during installation, less the cup hook slip out of the socket.

Known in the art is U.S. Pat. No. 6,711,974 B1 to Lin entitled "Positioning Device for Holding a Hook Screw." This patent teaches a generally cylindrical socket for the installation of hook eyes in conjunction with a hand held power drill. The socket has a polygonal passage that depends from its distal end. A hook eye is inserted into this passage. Near the end of this passage are tapered openings against which the hook eye rests. There are magnets to retain the hook eye within the socket.

This socket has the disadvantage of being complex and costly to manufacture with the employment of magnets to retain the hook eye in the socket. It is further disadvantaged in that brass is a non-magnetic metal alloy and the socket fails to magnetically retain brass cup hooks. Accordingly, a user would have to keep the socket in a prone position at all times during installation to avoid a cup hook from sliding out of the socket. The socket is still further disadvantaged by a hexagonal passage because, it appears that a brass cup hook would rattle around within the socket where there is no magnetic retention force. The socket is disadvantaged by the tapered openings minimally embracing the flange and adding complexity to manufacture.

It is known in the art to retain a thing in a socket using a set screw that is tighten and loosened.

Accordingly, there exists a need for a means to install cup hooks that does not employ manual turning of the cup hook.

There exists a need for a means to install cup hooks that does not require center punching or drilling a lead hole.

There exists a need for a means to install cup hooks that is suited for elevated locations and in particular, under eaves.

There exists a further need for a means to install cup hooks with variable reach as may be needed to suit the installation at a particular surface.

There exists a need for a socket to install cup hooks that is utilizable with a hand held power drill.

There exists a need for a means to install brass cup hooks that retains the cup hook in the means and frees a user from having to maintain the socket in a upright prone position at all times during installation.

There exists a need for a socket that retains a thing, such as a cup hook, without the use of a set screw, or similar structure, that requires tightening and loosening.

There exists a need for a means to install brass cup hooks that distributes back pressure when a cup hook is drilled into a surface.

There exists a need for a means to install brass cup hooks that is easy, quick and inexpensive to manufacture.

The present invention satisfies these needs, as well as others, and generally overcomes the presently known deficiencies in the art.

SUMMARY OF THE INVENTION

The present invention is directed to a socket for the installation of brass cup hooks that is utilized with a hand held power drill.

An object of the present invention is a means to install cup hooks that does not employ manual turning of the cup hook.

Another object of the present invention is a means to install cup hooks that does not require center punching or drilling a lead hole.

Another object of the present invention is a means to install cup hooks that is suited for elevated locations and in particular, under eaves.

Another object of the present invention is a means to install cup hooks with variable reach as may be needed to suit the installation at a particular surface.

Another object of the present invention is a socket to install cup hooks that is utilizable with a hand held power drill.

Another object of the present invention is a means to install brass cup hooks that retains the cup hook in the means and frees a user from having to maintain the socket in a upright prone position at all times during installation.

Another object of the present invention is a means to install brass cup hooks that distributes back pressure when a cup hook is drilled into a surface.

Another object of the present invention is a means to install brass cup hooks that is easy, quick and inexpensive to manufacture.

One aspect of the present invention is a rotator socket suitable for the installation of a cup hook. The cup hook is characterized by a shank having a threaded portion and a round hook portion with a semispherical flange mounted orthogonal on the shank where the hook has a wideness "w" a longitudinal distance "d" from the mounting position of the semi-spherical flange.

The socket is comprised of a shank having an axis with a first and second end. Mounted to an end of the shank is a body. The body has a rotational axis, a proximal end, a distal end, a periphery and a region for protrusion with a width that is less than "w" and occupying a distance "d" from the distal end. In more detail, the body is mounted by way of its proximal end to the shank with the rotational axis of the body and the axis of the shank being collinear.

The body has a slot. This slot depends from the distal end has a rotational axis collinear with the rotational axis of the body. The slot extends through the periphery at least in the region for protrusion so as to form first and second periphery openings. The slot is sized to accommodate the insertion of the rounded hook portion of a cup hook.

There is a depression in the body that depends from the distal end having a center that is collinear with the rotational axis of the body. This depression penetrates the slot, forms annular rim segments in the distal end and is sized to accommodate at least a portion of the semi-spherical flange of the cup hook.

There are one or more members provided about the periphery of the region for protrusion that pass over the first and second periphery openings where there is at least one member is a resilient member that passes over a periphery opening.

Another aspect of the present invention is a rotator socket for use with a handheld power drill suitable to install a cup hook. The cup hook is characterized as previously described with a rounded hook portion having wideness and a semi-spherical flange.

The rotator socket has a shank that has first and second ends, an axis and is adapted to be received in the chuck of a hand held power drill. Attached to end of the shank is a cylindrical body. The cylindrical body has an axis, an annular periphery, a proximal end, a distal end and a diameter that is marginally less than the wideness of the rounded hook portion of a cup hook. In more detail, the body is mounted by way of its proximal end to the shank with the axis of the body and the axis of the shank being collinear.

There is a rectangular slot disposed in the body that depends from the distal end, has a central axis which is collinear with the axis of the body, has a span and depth that accommodates the rounded hook portion of a cup hook in generally conforming fashion and extends through the body so as to form a first and second periphery openings in the periphery.

There is a depression in the body that depends from the distal end having a center that is collinear with the axis of the body, penetrates the slot, forms annular rim segments in the distal end and is sized to accommodate at least a portion of the flange of the cup hook. This depression is selected from the group consisting of a conical shaped cavity and a semi-spherical shaped cavity.

There is a resilient sleeve provided on a portion of the periphery which passes over at least a portion of the first and second periphery openings. This resilient sleeve is positioned so as to contact the rounded hook portion of a cup hook inserted into the slot with the semi-spherical flange resting against the rim segments such that the rounded hook extends through the periphery openings.

The previously described versions of the present invention have many advantages which include facilitating the hanging of Christmas lights, avoiding the fatigue of hand screwing hundreds to thousands of cup hooks used to hang Christmas lights, providing for the easy removal of cup hooks, being robust such that the user does not need to daintily keep a socket in a prone position in order to retain a cup hook in the socket, that there is no set screw or similar structure that is tightened and loosened to hold the cup hook in the socket, being gentle on the cup hook such that a user can exert a strong driving force when installing a cup hook without damaging the cup hook, affording an ability to install cup hooks in different locations at different elevations and/or with different volumes of access room, generally making cup hook installation easy, fast and convenient and being inexpensive and simple to manufacture.

BRIEF DESCRIPTION OF THE DRAWINGS

These and other features, aspects and advantages of the present invention will become better understood with reference to the following description, appended claims and accompanying drawings where:

DETAILED DESCRIPTION OF THE INVENTION

Figure 1:
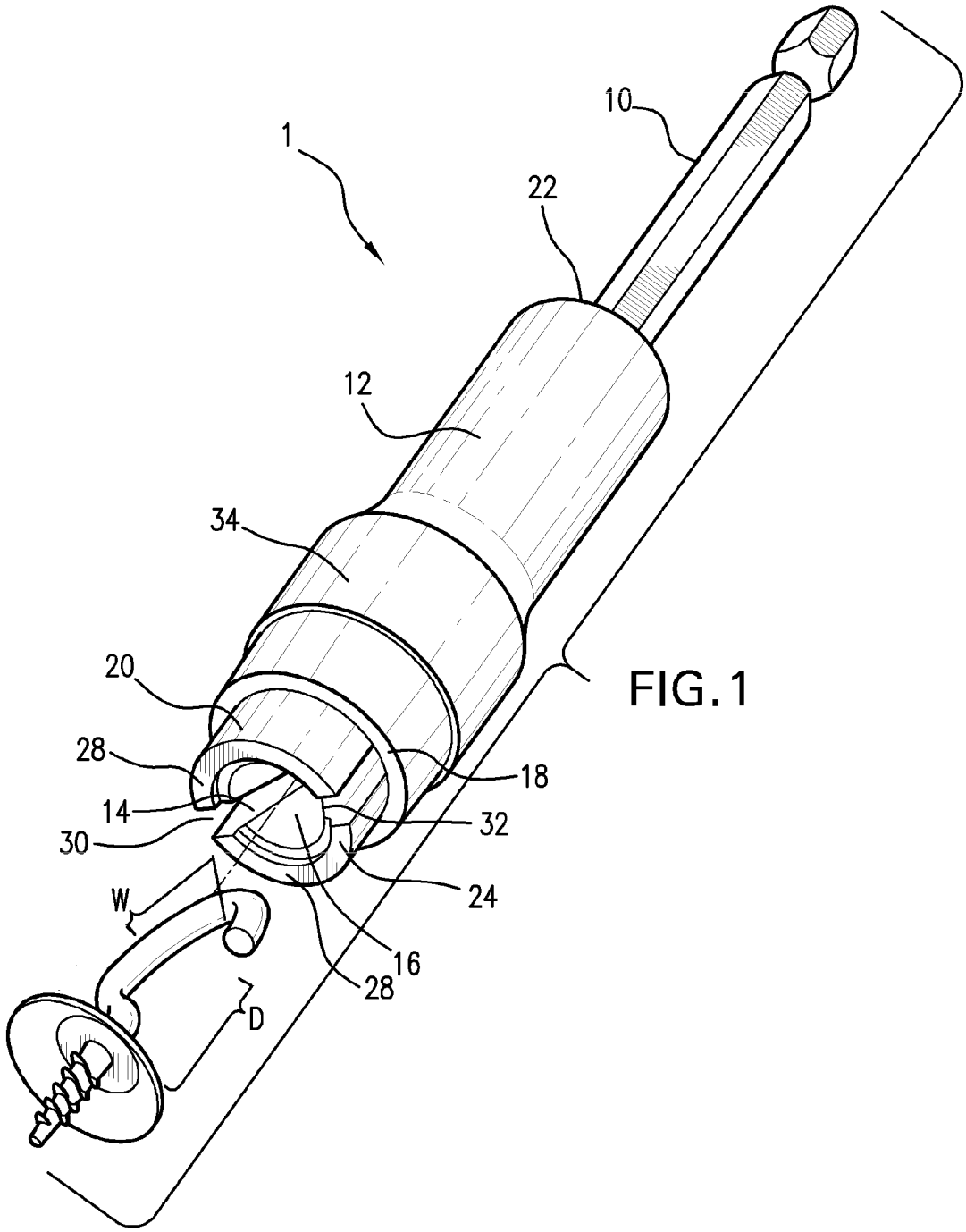
FIG. 1 shows a perspective view of a utensil according to the present invention along with a cup hook for loading into the utensil.

The present invention is described more fully in the following disclosure. In this disclosure, there is a discussion of embodiments of the invention and references to the accompanying drawings in which embodiments of the invention are shown. These specific embodiments are provided so that this invention will be understood by those skilled in the art. This invention is not limited to the specific embodiments set forth herein below and in the drawings. The invention is embodied in many different forms and should be construed as such with reference to the appended claims.

The present invention is directed a rotator socket for use with a handheld power drill suitable for the installation of a cup hook. A cup hook is characterized by a threaded shank having a pointed tip; a rounded hook portion that is continuous with the shank and a semi-spherical flange mounted orthogonal on the shank. The rounded hook portion has a wideness "w" a longitudinal distance "d" from the mounting position of the semispherical flange on the shank. Embodiments of the present invention can be sized to work with all, or virtually all, sized cup hooks. Embodiments of the present invention are preferably designed to work with a ⅞ inch cup hook which is believed to be the most commonly used cup hook; especially, for hanging Christmas lights.

Referring to the drawings collectively, in general terms and for an overview, various embodiments of this invention are comprised of the following major components or subassemblies: a shank (10); a body (12); a slot (14); a depression (16) and a resilient member (18). In the discussion that follows, each of these major components or subassemblies is discussed, along with other structures in the embodiments of this invention. Thereafter, there is a discussion on how to use the socket.

Referring to FIGS. 1, 2, 4 and 5, the shank (10) is a straight and narrow diameter shaft. The shank (10) has a rotational axis which runs longitudinally through the center of its cross-section. Typically, the shank (10) is adapted to be received in the chuck of a hand held power drill. A shank (10) having a hexagonal cross-section is preferred. The overall length of the shank (10) is generally at least long enough to fit securely in the chuck of a held drill. Preferably, the shank (10) is at least long enough to sit fully within the well of the chuck and have a connector space between the chuck and the body (12).

Figure 5:
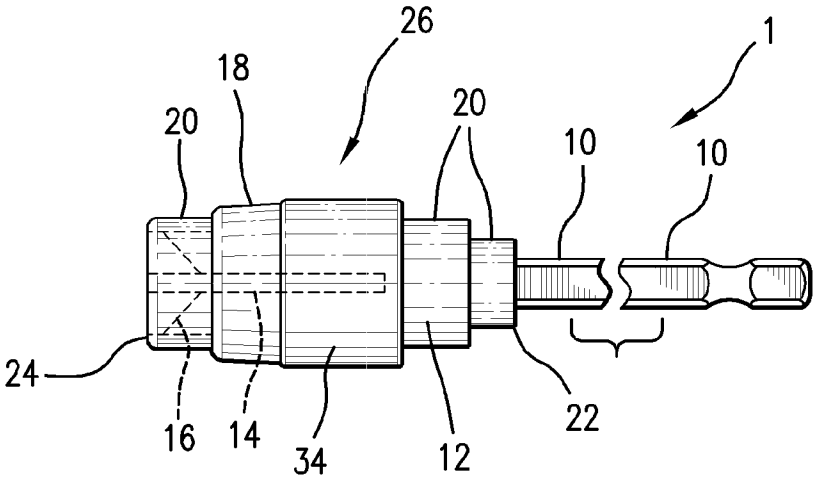
FIG. 5 shows a sectional elevational view of a utensil according to the present invention and FIG. 6 shows an elevational view of a utensil according to the present invention.

Referring to FIG. 5, in alternative embodiments, the overall length of the shank (10) is varied to suit installation needs. A longer length shank (10) provides a greater reach. In one embodiment of the present invention, there is a set of rotator sockets (1) having shanks (10) of various lengths and a user selects a socket (1) with a particular shank (10) length based on the amount of reach needed by the user. The overall length of the shank (10) typically ranges from about 1 to about 10 inches. More preferably, the overall length ranges from about 1.5 inches to about 8 inches. Even more preferable the overall is length is about 2 inches or about 3 inches.

The shank (10) is made out of steel, iron, aluminum, stainless steal, other metals, polyvinyl chloride or other hard plastics. Aluminum and stainless steel are preferred materials and aluminum is most preferred as being light weight, strong, durable and resistant to rusting.

Figure 2:
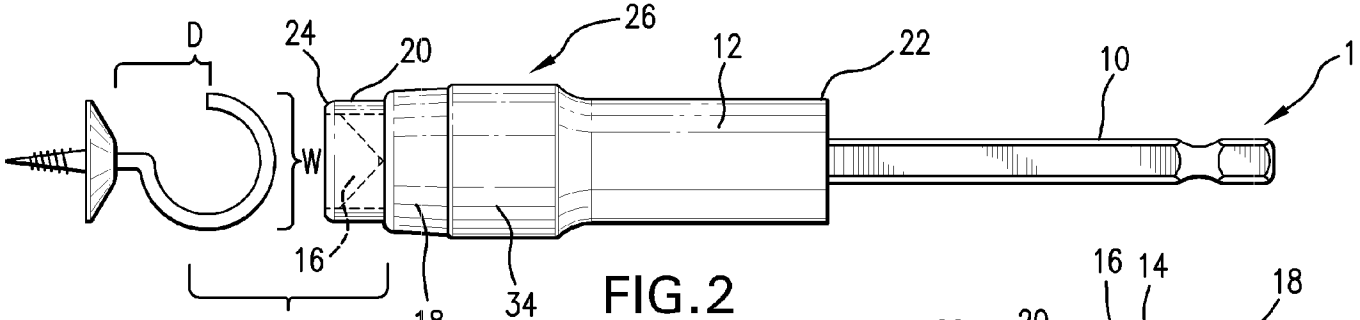
FIG. 2 shows an elevational view of a utensil according to the present invention along with a cup hook for loading into the utensil.
Figure 4:
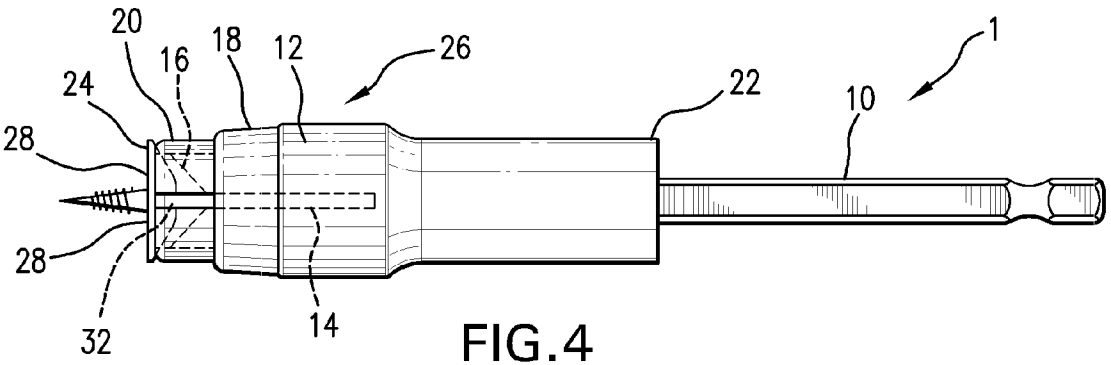
FIG. 4 shows an elevational view of a utensil according to the present invention along with a cup hook inserted into the utensil.

Referring to FIGS. 1, 2, and 4, the body (12) is a three dimensional object having length, width and thickness. The body (12) has a size that is a least long enough to accommodate the length of a slot (14), wide enough to accommodate a depression (16) and annular rim segments (28) and provide a structurally sound base. The slot (14) and depression (16) have a length that is sufficient for receiving therein the rounded hook and at least a portion of the semi-spherical flange of a cup hook. Preferably, the overall length of the body (12) typically ranges from about 2 inches to about 2½ with about 2 inches being more preferred.

The body (12) has a periphery (20), a proximal end (22), a distal end (24) and a rotational axis which passes through its center of mass. Preferably, the body (12) is symmetrical about the rotational axis so as to facilitate smooth rotation by a handheld power drill. In preferred embodiments, the body is a cube, an elongated cylinder having a polygon as a cross-section or an elongated cylinder having a circle as a cross-section with an elongated cylinder having a circle as a cross-section being most preferred.

Continuing to refer to FIGS. 1, 2, 3 and 4, there is a region for protrusion (26) of the body (12) that has a width that is less than a wideness of the rounded hook portion of a cup hook inserted in the slot (14). Preferably, the region for protrusion occupies a position a distance denominated "d" from the distal end (24) of the body (12), as described above. In a preferred embodiment, the region for protrusion (26) of the body (12) is marginally less wide than "w". Typically, the region for protrusion (26) has a length ranging from about one sixteenth of inch to the total length of the body (12). The rounded hook portion of a cup hook which has been inserted into a slot (14) such that the semi-spherical flange of the cup hook rests against annular rim segments (28) extends through periphery openings (30, 32) so as to contact a resilient member (18).

Referring to FIGS. 1, 2, 3 and 4, in a more preferred embodiment, the body (12) is a cylinder having a circle as a cross-section and the diameter of body, and concomitantly, also the diameter of the region for protrusion, is marginally less than the wideness "w" of the rounded hook portion of a cup hook to be inserted into the slot (14). In a still more preferred embodiment, the socket (1) is intended for the installation of a ⅞ inch cup hook and the region for protrusion (26) of the body (12) has an external diameter of about 0.625+/−0.004 inches.

Figure 6:
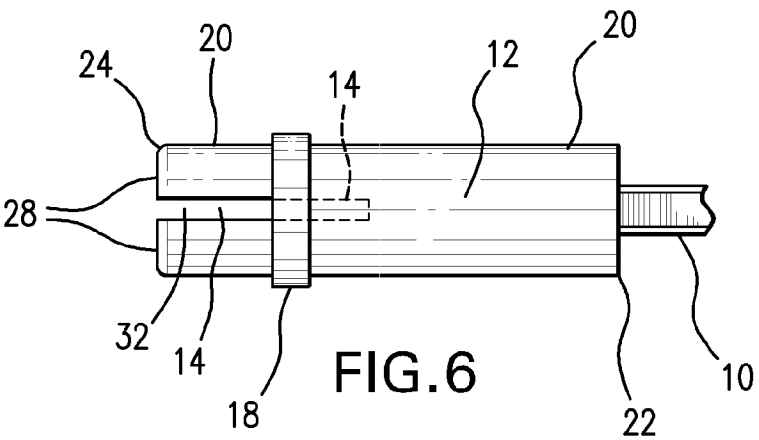

Referring to FIGS. 5 and 6, in alternative embodiments, the overall length of the body (12) is varied to suit the installation needs of a user where a longer length provides greater reach. In one embodiment of the present invention, there is a set of rotator sockets (1) of having bodies (12) of various lengths. A user selects a socket (1) with a particular body (12) length based on the amount of reach needed by the user.

The body (12) is made out of steel, iron, aluminum, stainless steal, other metals, polyvinyl chloride or other hard plastic. Aluminum and stainless steel are preferred materials and aluminum is most preferred as being light weight, strong, durable and resistant to rusting. In an alternative and preferred embodiment, the body (12) is made from metal and has a protective coating or laminate with a laminate being more preferred.

Figure 3:
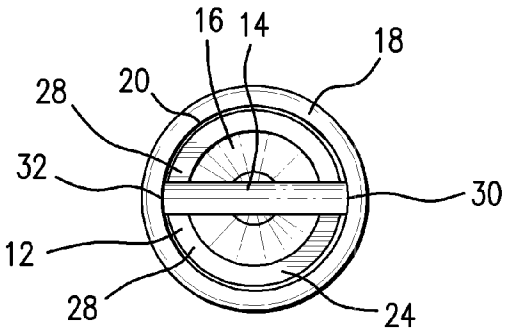
FIG. 3 shows a top plan view of an utensil according to the present invention.

Referring to FIGS. 1, 2 and 3, the body (12) is mounted to the shank (10) at its proximal end (22) such that the axis of the shank (10) and the axis of the body (12) are collinear. The body (12) can be mounted to the shank (10) by welding of flush surfaces, by insertion of the shank (10) into a post hole in the body (12) coupled with a friction fit, gluing or welding. In the alternative, the body (12) and shank (10) can be molded integral or machined integral. In a preferred embodiment, the post hole has a diameter between about 0.005 to about 0.010 inches less than the diameter (or effective diameter) of the shank and the shank is forced into the post hole using a press. In a more preferred embodiment, the post hole is 0.266 inches in diameter and ¼ inch hexagonal shaft is pressed into the post hole.

Referring to FIGS. 1, 3 and 4, there is a slot (14) disposed in the body (12) that depends from the distal end (24) of the body (12). The slot (14) is an elongated channel, groove or notch that receives or admits the rounded hook portion of a cup hook. The slot (14) has a central axis and it positioned within the body (12) so that its central axis is collinear with axis of the shank (10) and the axis of the body (12). The bottom of the slot can be flat, "V" shaped or arcuate with flat preferred to reduce fabrication cost. In a preferred embodiment, the slot (14) has rectangular shape.

Continuing to refer to FIG. 4, the slot (14) receives or admits the rounded hook portion of a cup hook. The slot has a span that is approximately wider than the thickness of the rounded hook portion of a cup hook. Preferably, the slot (14) is marginally wider than the thickness of the rounded hook portion of the cup hook. The slot (14) does not need to be fabricated to have a span that provides a conformed fit and/or a friction grip with the rounded hook portion of the cup hook. This advantageously reduces manufacturing costs by allowing for the use of less expensive molds and molding processes and/or the use of quicker and more course machining. For a socket (1) intended for the installation of a ⅞ inch cup hook, the span of the slot (14) is typically between about 0.110 inches to 0.135 inches with 0.125 inches most preferred.

Continuing to refer to FIG. 4, the slot (14) has a depth that so as to receive or admit the rounded hook portion of a cup hook. The slot (14) does not need to be fabricated to have a depth that provides a conformed fit or a contact base for the rounded hook portion of the cup hook. That is, the slot (14) can have a depth that extends below the most inferior point of the rounded hook portion of cup hook inserted into the slot (14) with a concomitant gap between that point and the bottom of the slot. This advantageously reduces manufacturing costs by allowing for the use of less expensive molds and molding processes and/or the use of quicker and more course machining. For a socket (1) intended for the installation of a ⅞ inch cup hook, the depth of the slot (14) is typically between about 0.865 inches to 0.925 inches with 0.875 inches most preferred.

Referring to FIGS. 1, 3 and 4, the slot (14) extends through the periphery (20) at least in the region for protrusion (26). At the junction of the slot (14) and the periphery (20) there is formed a first periphery opening (30) and a second periphery opening (32). These periphery openings (30, 32) are diametrically opposed. The rounded hook portion of a cup hook inserted into the slot (14) where the semi-spherical flange rests against the annular rim segments (28) and the rounded hook portion extends through the periphery openings (30, 32) to contact a resilient member (18).

Referring to FIGS. 1, 2, 3 and 4, the depression (16) depends from the distal end (24) of the body (12) and penetrates the slot (14). The depression is a lowered area or cavity leaving a surrounding surface that is an annular rim segment (28) on the distal end (24). The depression (16) is sized to receive at least a portion of the semi-spherical flange. The depression (16) does not need to be fabricated to conform fit to the semi-spherical flange. That is, there can be gaps and spaces between the semi-spherical flange and a proximal surface wall of the depression (16). This advantageously reduces manufacturing costs by allowing for the use of less expensive molds and molding processes and/or the use of quicker and more course machining. Typically, the depression has a shape selected from the group consisting of concave, conical and semi-spherical. A conical depression is more preferred and most preferred is a conical depression having a 60 degree angle. In embodiments of the invention, the semi-spherical flange contacts the annular rim segments (28) in a tangential or orthogonal manner.

Referring to FIGS. 1, 2, 3, 4, 5 and 6, one or more members (18) are provided about the periphery of the region for protrusion that pass over the first and second periphery openings (30, 32) where at least one of the members is a resilient member (18). The resilient member (18) is made from a material that has the property of elasticity and/or being stretchable with the capability of delivering an urging force as it seeks to return to its original size. The resilient member (18) is constructed to provide gripping strength that is large enough to retain a cup hook in the socket against the force of gravity and a gripping strength that is small enough that that the socket slides or pops off the cup hook after installation is complete.

Typically, the resilient member is a thin walled structure preferably having a thickness between about 0.030 inch to about 0.090 inches with 0.060 inches being more preferred. The resilient member (18) can be made from rubber, neoprene, polypropylene, polyvinyl chloride and other elastomers and plastic elastomers. A soft resilient material is more preferred and conversely, polyvinyl chloride which is a hard material is less preferred. A flexible plastic having a heat tolerance of about 632 degrees Fahrenheit, such as a plastic commonly used as a masking material in plating operations, is most preferred. Such a flexible material with a high heat stability delivers highly a satisfactory amount of gripping strength that is large enough to retain a cup hook in the socket against the force of gravity and a gripping strength that is small enough that that the socket easy slides or pops off the cup hook after installation is complete.

The resilient member can be a short strip that spans the periphery opening (30, 32) and is mounted to the body (12) at positions across adjacent sides of the slot (14) at the periphery opening (30, 32). The resilient member (18) can be mounted to the body (12) by a penetrating fastener, clip or clasp or be clamped into a specially provided slot for retaining the resilient member.

Referring to FIGS. 1, 2, 3, 4 5 and 6, in a preferred embodiment, the resilient member (18) is a resilient sleeve (18). The resilient sleeve (18) is a hollow and thin walled enclosure that is configured to conformingly overlay around the region for protrusion (26) and occupying a distance "d" from the distal end (24) of the body (12). Typically, the resilient sleeve (18) has an internal perimeter that is marginally less than the corresponding outer perimeter of the body (12) which it overlays.

Referring to FIGS. 1, 2, 4 and 5, in a more preferred embodiment, the body (12) is a cylinder having a circular cross-section and the resilient sleeve (18) is a hollow cylindrical enclosure; namely, an elongated tube or a stubby band. Referring to FIG. 6, in an alternative embodiment, resilient member (18) can be an "O" ring.

Referring to FIGS. 1, 2, and 4, in a preferred embodiment, there is band (34) of material that is laminated over at least a portion of the flexible sleeve (18) and a portion of the periphery (20) so as to retain the sleeve (18) on the periphery (20). The band can be made from polyvinyl chloride or polypropylene. In a more preferred embodiment, the band is a heat shrink material or laminate that passes over at least a portion of the flexible sleeve (18) and on a portion of the periphery (20) so as to retain the sleeve (18) on the periphery (20). In a more preferred embodiment there is an annular ring in the body into which the band contracts so as to help retain the band.

One use of the rotator socket is to hang cup hooks. Another use of the rotator socket is to put up decorative lighting strings (namely, Christmas lights) that are hung using cup hooks. The rotator socket can also be used to remove cup hooks. The rotator socket is particular advantageous in hanging cup hooks under eaves, on fascia boards and in other elevated locations.

To use the rotator socket (1), a user inserts the shank (10) of the socket (1) into the chuck of a hand held power drill and tightens the chuck. Next, the user grasps a cup hook by its shank. While holding the cup hook in such a manner, the user inserts the rounded hook end of the cup hook into the socket (1). The rounded cup hook end is passed through the depression (16) of the socket (1). The rounded cup hook end is passed into the slot (14) until the semi-spherical flange of the cup hook contacts the annular rim segments (28).

In an advantageous manner, the resilient sleeve (18) releasably retains the cup hook by a friction grip against longitudinal motion within the socket. When a cup hook is so inserted in the socket, the threaded portion of the shank of the cup hook with its pointed tip projects away from the socket (1).

A user positions the handheld drill so as to nestle the pointed tip of the cup hook shank against a surface at the location where it is desired that the cup hook be installed. The user can press lightly with the handheld drill to force the cup hook tip a "micro" distance into the surface to create a lead hole. Less preferably, in the alternative, a lead hole can be punched in advance using a center punch and hammer.

The user than actuates the hand held drill and applies pressure. The cup hook shank is drilled into the surface. When the underside of the semi-spherical flange contacts the surface, the user de-actuates the drill. The drill is withdrawn and the socket slides or pops off the cup hook.

To remove a cup-hook from a surface, the above process is reversed. The socket (1) is fitted over a cup hook that has been screwed into a surface. The hand held power drill is operated in reverse to unscrew the cup hook from the surface.

The previously described versions of the present invention have many advantages. One advantage is facilitating the hanging of Christmas lights. Another advantage is avoiding the fatigue of hand screwing hundreds to thousands of cup hooks used to hang Christmas lights. Another advantage is providing for the easy removal of cup hooks. Another advantage is being robust such that the user does not need to daintily keep a socket in a prone position in order to retain a cup hook in the socket. Another advantage is that there is no set screw or similar structure that is tighten and loosened to hold the cup hook in the socket. Another advantage is being gentle on the cup hook such that a user can exert a strong driving force when installing a cup hook without damaging the cup hook. Another advantage is affording an ability to install cup hooks in different locations at different elevations and/or with different volumes of access room. Another advantage is generally making cup hook installation easy, fast and convenient. Another advantage is being inexpensive and simple to manufacture.

EXAMPLES

The following examples further describe and demonstrate embodiments within the scope of the present invention. The examples are given solely for the purpose of illustration and are not to be construed as limitations or restrictions of the present invention, as persons skilled in the art will quickly realize many variations thereof are possible that are all within the spirit and scope of the invention.

Example 1

In Example 1 a rotator socket was made that was configured for the installation of a ⅞ inch cup hook. The overall length of the socket was 2.00 inches. The socket had a circular cross-section with an outside diameter of 0.625 inches. The width or span of the slot was 0.125 inches and the depth of the slot was 0.875 inches. A depression was machined into the distal end by first drilling a hole on center using a ½ (0.500) inch drill bit to a depth of 0.090 inches. Beneath this, a conical section was machined having 60 degree angle. At the proximal end, a hole was drilled on center having 0.266 inch diameter using an "H" size bit to a depth of 0.875 inches to receive a shank. A standard ¼ inch hex material was press fitted into this hole as a shank. A band of a soft resilient material was made from flexible plastic having a heat tolerance of about 632 degrees Fahrenheit that is commonly used as a masking material in plating operations. The band had an inside diameter of 0.625 inches, a wall thickness of 0.060 inches and a length of 0.625 inches. The band was slipped over the slot roughly about 0.1 inch from the distal end of the socket.

Example 2

Example 2 is a rotator socket as in Example 1 where an annular groove having an outside diameter of 0.575 inches and a length of 0.150 inches is machined into the body at a position starting 0.250 inches from the proximal end of the socket. The rotator socket was outfitted with a band of heat shrink polyvinyl chloride that wrapped over ("walked around") the resilient material, socket body and annular groove. The band was heat shrunk so as to lock the resilient material so that it does not move back and forth.

Example 3

Example 3 is a hypothetical example of the socket in Example 1 where the resilient material is an "O" ring as in FIG. 6.

Example 4

Example 4 is a hypothetical example of the socket in Example 2 where the resilient material is an "O" ring as in FIG. 6.

Example 5

A rotator socket as in Example 2 was inserted by its shank and secured in the chuck of a power drill. A ⅞ inch cup hook having round wire with a diameter of about 0.105 inches was slid into the rotator socket. The round portion of the cup hook wire pressed against the flexible material (sleeve.) The sliding was easy and the cup hook was held in place against gravity within the rotator socket by pressure exerted by flexible material (sleeve.) The cup hook was installed into a surface. Thereafter, when the rotator socket was withdrawn and it slid (popped) easily off the cup hook.

Example 6

As in Example 5, a rotator socket of Example 2 was inserted by its shank and secured in the chuck of a power drill and a cup hook was inserted. The cup hook was grasped lightly by the resilient material and did not fall out of the rotator socket. An individual climbed a ladder grasping the ladder with one hand and holding the drill in the other hand. At times, the drill faced downward and the cup hook did not fall out of the rotator socket. The individual pressed the pointed end of the screw portion of the cup hook against a wood surface. The cup hook did not deflect. There was no lead hole. The individual started the drill and the cup hook was screwed into the wood surface. Thereafter, the drill was withdrawn and the cup hook released from the rotator socket. The resilient material gripped the cup hook with a strength that was just strong enough to resist gravity such that the rotator socket easily came off the cup hook after it was driven into the surface.

Although the present invention has been described in considerable detail with reference to certain preferred versions thereof, other versions are possible with substituted, varied and/or modified materials and steps are employed. These other versions do not depart from the invention. Therefore, the spirit and scope of the appended claims should not be limited to the description of the preferred versions contained herein.

What is claimed is:

1. A rotator socket suitable for the installation of a cup hook, the cup hook characterized by a shank having a threaded portion and a round hook portion with a semispherical flange mounted orthogonal on the shank where the hook has a wideness "w" a longitudinal distance "d" from the mounting position of the semi-spherical flange, comprised of:

a) a shank having an axis;

b) a body having a rotational axis, a proximal end, a distal end, a periphery and a region for protrusion with a width that is less than "w" and occupying a distance "d" from the distal end and said body is mounted by way of its proximal end to the shank with the rotational axis of the body and the axis of the shank being collinear, wherein the region for protrusion defines:

i) a first region extending from the distal end toward the proximal end a distance less than "d" and ii) a second region extending from the first region to define the reminder of said occupying distance "d";

c) a slot in the body that depends from the distal end having a rotational axis collinear with the rotational axis of the body that extends through the periphery at least in the region for protrusion along the width so as to form first and second periphery openings and sized to accommodate the insertion of the rounded hook portion of a cup hook;

d) a depression in the body that depends from the distal end having a center that is collinear with the rotational axis of the body that penetrates the slot, forms annular rim segments in the distal end and is sized and shaped to accommodate at least a portion of the semi-spherical flange of the cup hook;

e) at least one members provided exclusively about the periphery in the second region that pass over the first and second periphery openings where at least one member is a resilient member which delivers an urging force that restrains a cup hook inserted into the slot from longitudinal motion with a gripping strength that is large enough to retain the cup hook in the slot against the force of gravity and a gripping strength that is small enough that the cup hook slides within the slot after installation of the cup hook into a surface; and f) a band being provided on at least a portion of said at least one member and on a portion of the periphery so as to retain said at least one member on the periphery.

2. The rotator socket of claim 1 where the shank is adapted to be received in the chuck of a hand held power drill.

3. The rotator socket of claim 1 where the body is a cylindrical body having a circular cross-section.

4. The rotator socket of claim 3 where one member is provided to pass over the first and second periphery openings and this member is a flexible sleeve.

5. The rotator socket of claim 1 where the region for protrusion has a width marginally less than "w".

6. The rotator socket of claim 1 where the slot is substantially rectangular.

7. The rotator socket of claim 1 where the depression is selected from the group consisting of a conical shaped cavity and a semi-spherical shaped cavity.

8. A rotator socket for use with a handheld power drill suitable to install a cup hook, the cup hook characterized by a shank having a threaded portion and a round hook portion with a semispherical flange mounted orthogonal on the shank where the hook has a wideness "w" a longitudinal distance "d" from the mounting position of the semi-spherical flange, comprised of:

a) shank having an axis that is adapted to be received in the chuck of a hand held power drill;

b) a cylindrical body having an axis, an annular periphery, a proximal end a distal end, and a region for protrusion with a width that is less than "w" and occupying a distance "d" from the distal end and said body is mounted by way of its proximal end to the shank with the axis of the body and the axis of the shank being collinear, wherein the region for protrusion defines:

i) a first region extending from the distal end toward the proximal end a distance less than "d" and ii) a second region extending from the first region to define the reminder of said occupying distance "d";

c) a rectangular slot disposed in the body that depends from the distal end, has a central axis which is positioned collinear with the axis of the body, has a span and depth that accommodates the rounded hook portion of a cup hook and extends through the periphery at least in the region for protrusion so as to form a first and second periphery openings in the periphery;

d) a depression in the body that depends from the distal end having a center that is collinear with the axis of the body that penetrates the slot, forms annular rim segments in the distal end and is sized and shaped to accommodate the semi-spherical flange of the cup hook and e) a resilient sleeve provided exclusively about the periphery in the second region that passes over at least a portion of the first and second periphery openings which delivers an urging force that restrains a cup hook inserted into the slot from longitudinal motion with a gripping strength that is large enough to retain the cup hook in the slot against the force of gravity and a gripping strength that is small enough that the cup hook slides within the slot after installation of the cup hook into a surface; and f) a band being provided on at least a portion of the resilient sleeve and on a portion of the periphery so as to retain the sleeve on the periphery.

9. The rotator socket of claim 8 where the shank has a hexagonal cross-section.

10. The rotator socket of claim 8 where the width of the region for protrusion is marginally less than "w".

11. The rotator socket of claim 8 where the depression is selected from the group consisting of a conical shaped cavity and a semi-spherical shaped cavity.

12. A rotator socket for use with a handheld power drill suitable to install a cup hook, the cup hook characterized by a rounded hook portion having wideness and a semi-spherical flange, comprised of:

a) shank having an axis that is adapted to be received in the chuck of a hand held power drill;

b) a cylindrical body having a circular cross-section, an axis, a periphery, a proximal end, a distal end, a diameter that is marginally less than the wideness of the rounded hook portion of a cup hook and a region for protrusion with a width and occupying a distance "d" from the distal end and said body is mounted by way of its proximal end to the shank with the axis of the body and the axis of the shank being collinear, wherein the region for protrusion defines:

i) a first region extending from the distal end toward the proximal end a distance less than "d" and ii) a second region extending from the first region to define the reminder of said occupying distance "d";

c) a rectangular slot disposed in the body that depends from the distal end, has a central axis which is collinear with the axis of the body, has a span and depth that accommodates the rounded hook portion of a cup hook in generally conforming fashion and extends through the body so as to form a first and second periphery openings in the periphery;

d) a depression in the body that depends from the distal end having a center that is collinear with the axis of the body, penetrates the slot, forms annular rim segments in the distal end and is sized and shaped to accommodate the flange of the cup hook and is selected from the group consisting of a conical shaped cavity and a semi-spherical shaped cavity;

e) a resilient sleeve provided exclusively about the periphery in the second region which passes over at least a portion of the first and second periphery openings and is positioned so as to contact the rounded hook portion of a cup hook that extends through the periphery openings of a cup hook inserted into the slot with the semi-spherical flange resting against the rim segments which delivers an urging force that restrains a cup hook inserted into the slot from longitudinal motion with a gripping strength that is large enough to retain the cup hook in the slot against the force of gravity and a gripping strength that is small enough that the cup hook slides within the slot after installation of the cup hook into a surface; and f) a band being provided on at least a portion of the resilient sleeve and on a portion of the periphery so as to retain the sleeve on the periphery.

13. The rotator socket of claim 12 where the shank has a hexagonal cross-section.

14. The rotator socket of claim 12 where the depression is a conical shaped cavity.

* * * * *